US008592121B2

(12) United States Patent
Matsumura

(10) Patent No.: US 8,592,121 B2
(45) Date of Patent: Nov. 26, 2013

(54) ELECTROSTATIC IMAGE DEVELOPING TONER FOR PRESSURE FIXING, PRODUCTION METHOD OF THE SAME, ELECTROSTATIC IMAGE DEVELOPER, IMAGE FORMING METHOD AND IMAGE FORMING APPARATUS

(75) Inventor: Yasuo Matsumura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 932 days.

(21) Appl. No.: 12/400,200

(22) Filed: Mar. 9, 2009

(65) Prior Publication Data

US 2009/0226834 A1 Sep. 10, 2009

(30) Foreign Application Priority Data

Mar. 10, 2008 (JP) ..... 2008-59708
Feb. 25, 2009 (JP) ..... 2009-41813

(51) Int. Cl.
*G03G 9/093* (2006.01)
*G03G 13/06* (2006.01)

(52) U.S. Cl.
USPC ..... 430/110.3; 430/110.1; 430/124.1; 430/124.23; 430/137.14

(58) Field of Classification Search
USPC ..... 400/110.1, 110.2; 430/110.1, 110.2, 430/110.3, 110.4, 124.23, 124.1, 137.14, 430/137.17
See application file for complete search history.

(56) References Cited

U.S. PATENT DOCUMENTS

| | | | | |
|---|---|---|---|---|
| 5,250,382 | A | 10/1993 | Shimojo et al. | |
| 5,753,399 | A * | 5/1998 | Hayase et al. | 430/109.3 |
| 6,632,883 | B2 | 10/2003 | Mayes et al. | |
| 2005/0208414 | A1 * | 9/2005 | Nakamura et al. | 430/110.2 |

FOREIGN PATENT DOCUMENTS

| | | |
|---|---|---|
| AU | 2006235981 A1 | 12/2007 |
| JP | A-6-167830 | 6/1994 |
| JP | A-6-342225 | 12/1994 |
| JP | A-2007-293045 | 11/2007 |
| JP | A-2007-310064 | 11/2007 |
| JP | A-2007-322953 | 12/2007 |

OTHER PUBLICATIONS

Feb. 9, 2010 Office Action issued in Japanese Patent Application No. 2009-041813 (with translation).

* cited by examiner

*Primary Examiner* — Jonathan Jelsma
(74) *Attorney, Agent, or Firm* — Oliff & Berridge, PLC

(57) ABSTRACT

An electrostatic image developing toner for pressure fixing includes a binder resin that has a sea-island structure, wherein a difference between a glass transition temperature of a resin forming the sea phase and a glass transition temperature of a resin forming the island phase is about 30° C. or more, both of the glass transition temperatures of the resin forming the sea phase and the resin forming the island phase are less than about 55° C., and the island phase has a major axis of about 150 nm or less.

7 Claims, No Drawings

ELECTROSTATIC IMAGE DEVELOPING TONER FOR PRESSURE FIXING, PRODUCTION METHOD OF THE SAME, ELECTROSTATIC IMAGE DEVELOPER, IMAGE FORMING METHOD AND IMAGE FORMING APPARATUS

CROSS-REFERENCE TO RELATED APPLICATIONS

This application is based on and claims priority under 35 USC 119 from Japanese Patent Application Nos. 2008-59708 and 2009-41813 filed on Mar. 10, 2008 and Feb. 25, 2009, respectively.

BACKGROUND

1. Technical Field

The present invention relates to an electrostatic image developing toner for pressure fixing, a production method of the same, an electrostatic image developer, an image forming method and an image forming apparatus.

2. Related Art

In the case where a polymer having randomly linked monomer chains, such as addition-polymerizable resin or polycondensation resin, is used as the binder resin of a toner, the fixing is promoted mainly by heating rather than by pressure and therefore, as regards the reduction in energy necessary for fixing in an electrophotographic system and the like, improvement with great deviation from the trend is not allowed to proceed. Also, there is not a simple fixing unit for realizing high-speed fixing in using a cardboard, which is important so as to cope with the market of printing by an electrophotographic system.

In order to realize a high-quality image at a high speed with a simple fixing unit by reducing the energy necessary for fixing and improving uneven gloss that is readily generated in high-speed fixing of a cardboard by heat fixing, promotion of plasticization by the pressure of toner is considered to be effective, but it is difficult in conventional polymerization to precisely design a resin structure enabling promotion of plasticization by pressure.

On the other hand, a certain combination using polymers that are hard (high glass transition temperature (Tg)) and soft (low Tg), respectively, at ordinary temperature exhibits flowability under pressure at not higher than the melting point of those polymers and therefore, can be pressure-formed at a temperature not higher than the melting point. A polymer material having such a property is called a baroplastic.

SUMMARY

According to an aspect of the invention, there is provided an electrostatic image developing toner for pressure fixing, including: a binder resin that has a sea-island structure, wherein a difference between a glass transition temperature of a resin forming the sea phase and a glass transition temperature of a resin forming the island phase is about 30° C. or more, both of the glass transition temperatures of the resin forming the sea phase and the resin forming the island phase are less than about 55° C., and the island phase has a major axis of about 150 nm or less.

DETAILED DESCRIPTION

I. Electrostatic Image Developing Toner for Pressure Fixing

The electrostatic image developing toner for pressure fixing (hereinafter sometimes simply referred to as an "electrostatic image developing toner" or a "toner") includes a binder resin that has a sea-island structure, wherein a difference between a glass transition temperature of a resin forming the sea phase and a glass transition temperature of a resin forming the island phase is about 30° C. or more, both of the glass transition temperatures of these resins are less than about 55° C., and the island phase has a major axis of about 150 nm or less. The present invention is described in detail below. Incidentally, in the context of the present invention, unless otherwise indicated, the expression "from 1 to 10" or the like referring to a numerical range has the same meaning as "1 or more and 10 or less" or the like.

An object of the present invention is to provide an electrostatic image developing toner for pressure fixing, ensuring that the pressure fixability is excellent, an image defect due to adhesion (filming) of the toner to a photoreceptor is hardly generated and an image with excellent image quality is obtained, a production method of the same, an electrostatic image developer, an image forming method using the toner, and an image forming apparatus.

That is, the object of the present invention is to enable pressure fixing with relatively small heating, preferably at ordinary temperature (temperature inside of the machine: 50° C. or less), while achieving reliability, for example, in terms of fixability, prevention of curling and waving of paper sheet, and continuous preservation of image quality.

In conventional pressure fixing involving heating, a high pressure is locally applied, as a result, particularly in the case of a high image coverage as in a color image, a problem such as curling or waving of paper sheet readily occurs by the effect of a difference in a residual stress between the toner layer and the paper layer. The object of the present invention is to enable pressure fixing without heating and obtain a high-quality image while suppressing curling or waving of paper sheet.

The present invention actively utilizes pressure plasticization of a resin composed of microphase-separated domains differing in the glass transition temperature (Tg), which is effected by the fixing pressure, and produces a basic effect that pressure fixability and reliability both can be satisfied.

In the case where a resin having a high glass transition temperature (hereinafter sometimes referred to as a "high Tg resin") and a resin having a low glass transition temperature (hereinafter sometimes referred to as a "low Tg resin") form a microscopically phase-separated state, the resin exhibits a plasticizing behavior for a pressure even in a state of being not heated and exhibits flowability even in an ordinary temperature region under a given pressure or more. Such a resin is sometimes called a baroplastic. By utilizing a baroplastic as the binder resin of an electrostatic image developing toner, resin flowability necessary for fixing can be obtained even by a simple pressure fixing machine.

In an electrophotographic process, when the toner is allowed to exhibit a flowable behavior under a given pressure or more and behave in a truly solid manner under no pressure, reliability can be ensured, for example, adhesion of the toner to the photoreceptor can be suppressed in the steps other than pressure fixing, such as developing, transfer and cleaning steps.

The thus-imparted reliability enables use of a toner having a small particle size of 5 μm or less, which has been conventionally desired to realize. As a result, reduction in the consumption of toner and formation of a high-definition image can be accomplished and all of high image quality, high reliability and profitability owing to reduction in the consumption of toner can be satisfied.

As regards the method for forming a state of a high Tg resin and a low Tg resin being microscopically phase-separated so as to bring out pressure plasticizing behavior, for example, a method of forming a block copolymer composed of a high Tg segment and a low Tg segment, or a method of aggregating and fusing resin particles having a core-shell structure composed of a core and a shell differing in Tg, may be considered, but the present invention proposes a method of aggregating and fusing resin particles differing in Tg, thereby realizing a state of a high Tg resin and a low Tg resin being microscopically phase-separated.

<Resin Particle Liquid Dispersion>

In the present invention, a high Tg resin and a low Tg resin contained in the binder resin form a sea-island structure.

The binder resin having a sea-island structure by the combination of a high Tg resin and a low Tg resin exhibits a pressure plasticizing behavior whichever resin is a sea phase or an island phase, but for satisfying both the pressure plasticizing behavior after forming a toner and the durability during transportation, storage and the like, the sea phase is preferably a high Tg resin.

In the electrostatic image developing toner for pressure fixing of the present invention, the difference between the glass transition temperature of the resin forming the sea phase and the glass transition temperature of the resin forming the island phase is about 30° C. or more, preferably about 35° C. or more.

If the difference between the glass transition temperatures of the high Tg resin and the low Tg resin is less than 30° C., the plasticizing behavior by pressure is scarcely observed and fixing or the like under a higher pressure or higher temperature condition is required, which incurs a damage of the paper sheet, such as curling and waving.

The glass transition temperature of the high Tg resin is less than about 55° C., preferably from about 40° C. to less than about 54° C., more preferably from about 45° C. to less than about 53° C.

If the glass transition temperature of the high Tg resin is 55° C. or more, a fixing behavior by pressure can be hardly exhibited at ordinary temperature (temperature inside of a printer: 50° C. or less).

When the temperature of the high Tg resin is 40° C. or more, the toner can have excellent storability and be prevented from caking at the transportation or in a machine such as printer and also filming to a photoreceptor, which occurs during continuous printing, or image defect can be suppressed. Furthermore, the pressure necessary for fixing is appropriate and a damage such as curling is scarcely caused on the paper.

The glass transition temperature of the resin can be measured by a known method, for example, may be measured by a method (DSC method) specified in ASTM D3418-82.

The major axis of the island phase contained in the electrostatic image developing toner for pressure fixing of the present invention is about 150 nm or less.

As for the microscopically phase-separated state formed by the high Tg resin and the low Tg resin, particularly the low Tg resin phase working out to an island phase needs to be finely distributed, and the major axis of the island phase is about 150 nm or less, preferably from about 5 nm to about 150 nm, more preferably from about 50 nm to about 140 nm, still more preferably from about 100 nm to about 130 nm.

If the major axis of the island phase exceeds 150 nm, the pressure plasticizing behavior becomes insufficient to bring an inadequate fixing degree at the pressure fixing, and fall-off of the image is liable to occur when the image is rubbed with cloth or the like.

When the major axis of the island phase is 5 nm or more, the high Tg resin and the low Tg resin successfully form a sea-island structure without mixing and dissolving and caking (blocking) occurring due to plasticization even at ordinary temperature under no pressure is not generated, so that the toner can nicely function as an electrostatic image developing toner for pressure fixing.

The major axis of the island phase can be evaluated by burying a toner sample in an epoxy resin or the like, producing a toner section by means of a diamond knife, and observing it through a transmission electron microscope.

The major axis of the island phase can be determined, for example, by arbitrarily selecting 100 island phases out of the island phases observed in the section and calculating the average major axis by the use of a Luzex image analyzer.

The ratio of the weight of the resin forming the island phase to the weight of the resin forming the sea phase is preferably about 0.25 or more.

For bringing out an appropriate pressure plasticizing behavior, the weight ratio of the low Tg resin contained in the electrostatic image developing toner is preferably about 0.3 or more, more preferably about 0.4 or more, still more preferably about 0.5 or more, based on the weight of the high Tg resin.

Also, the weight ratio of the low Tg resin is preferably less than 1.5 based on the weight of the high Tg resin. When the weight ratio is less than 1.5, the problem of plasticization at ordinary temperature is not caused.

The resin which can be used for forming a sea-island structure is not particularly limited as long as Tg differs by about 30° C. or more between the resin working out to a sea phase and the resin working out to an island phase, but an addition-polymerization type resin or a polycondensation resin is preferred.

Preferred examples of the monomer constituting the homopolymer or copolymer as the addition-polymerization resin include styrenes such as styrene, parachlorostyrene and α-methylstyrene; (meth)acrylic acid esters such as methyl acrylate, ethyl acrylate, propyl acrylate, butyl acrylate, lauryl acrylate, 2-ethylhexyl acrylate, methyl methacrylate, ethyl methacrylate, propyl methacrylate, butyl methacrylate, hexyl methacrylate, lauryl methacrylate and 2-ethylhexyl methacrylate; (meth)acrylonitriles such as acrylonitrile and methacrylonitrile; ethylenically unsaturated carboxylic acids such as acrylic acid, methacrylic acid and crotonic acid; vinyl ethers such as vinyl methyl ether and vinyl isobutyl ether; vinyl ketones such as vinyl methyl ketone, vinyl ethyl ketone and vinyl isopropenyl ketone; olefins such as isoprene, butene and butadiene; and β-carboxyethyl acrylate. A homopolymer composed of such a monomer, a copolymer obtained by copolymerizing two or more of these monomers, or a mixture thereof may be used.

The resin may contain an acidic or basic polar group or an alcoholic hydroxyl group, if desired. Preferred examples of the acidic polar group include a carboxyl group, a sulfonic acid group and an acid anhydride.

Examples of the monomer for forming an acidic polar group in the resin include an α,β-ethylenically unsaturated compound having a carboxyl group or a sulfonic acid group, and specific preferred examples thereof include acrylic acid, methacrylic acid, fumaric acid, maleic acid, itaconic acid, cinnamic acid, sulfonated styrene and allylsulfosuccinic acid.

Preferred examples of the basic polar group include amino group, amide group and hydrazide group. Examples of the monomer for forming a basic polar group in the resin include a monomer having a nitrogen atom (hereinafter, sometimes referred to as a "nitrogen-containing monomer"). Preferred examples of the compound used as the nitrogen-containing monomer include a (meth)acrylic amide compound, a (meth) acrylic hydrazide compound and an aminoalkyl(meth)acrylate compound.

As for examples of these nitrogen-containing monomers, examples of the (meth)acrylic amide compound include acrylic amide, methacrylic amide, acrylic methylamide, methacrylic methylamide, acrylic dimethylamide, acrylic diethylamide, acrylic phenylamide and acrylic benzylamide.

Examples of the (meth)acrylic hydrazide compound include acrylic hydrazide, methacrylic hydrazide, acrylic methylhydrazide, methacrylic methylhydrazide, acrylic dimethylhydrazide and acrylic phenylhydrazide.

Examples of the aminoalkyl(meth)acrylate compound include 2-aminoethyl acrylate and 2-aminoethyl methacrylate. The aminoalkyl(meth)acrylate compound may be a monoalkylaminoalkyl(meth)acrylate compound or a dialkylaminoalkyl(meth)acrylate compound, and examples thereof include 2-(diethylamino)ethyl(meth)acrylate.

The monomer for forming an alcoholic hydroxy group is preferably hydroxy(meth)acrylates, and specific examples thereof include 2-hydroxyethyl(meth)acrylate, hydroxypropyl(meth)acrylate and hydroxybutyl(meth)acrylate.

The term "(meth)acrylate" above is an abbreviation notation indicating that both structures of methacrylate and acrylate can be taken.

A chain transfer agent is preferably used at the polymerization of addition polymerization resin.

The chain transfer agent is not particularly limited, but a compound having a thiol component may be preferably used. Specific preferred examples thereof include alkylmercaptans such as hexylmercaptan, heptylmercaptan, octylmercaptan, nonylmercaptan, decylmercaptan and dodecylmercaptan. Use of a chain transfer agent narrows the molecular weight distribution in the binder resin and this is preferred because good toner storability at high temperatures can be attained.

The addition polymerization resin usable in the present invention can be formed into a crosslinked resin by adding a crosslinking agent thereto, if desired. The crosslinking agent is typically a polyfunctional monomer having two or more ethylenically unsaturated groups within the molecule.

Specific examples of the crosslinking agent include aromatic polyvinyl compounds such as divinylbenzene and divinylnaphthalene; polyvinyl esters of aromatic polyvalent carboxylic acid, such as divinyl phthalate, divinyl isophthalate, divinyl terephthalate, divinyl homophthalate, divinyl/trivinyl trimesate, divinyl naphthalenedicarboxylate and divinyl biphenylcarboxylate; divinyl esters of nitrogen-containing aromatic compound, such as divinyl pyridinedicarboxylate; vinyl esters of unsaturated heterocyclic compound carboxylic acid, such as vinyl pyromucate, vinyl furancarboxylate, vinyl pyrrole-2-carboxylate and vinyl thiophenecarboxylate; (meth)acrylic acid esters of linear polyhydric alcohol, such as butanediol methacrylate, hexanediol acrylate, octanediol methacrylate, decanediol acrylate and dodecanediol methacrylate; (meth)acrylic acid esters of branched, substituted polyhydric alcohol, such as neopentyl glycol dimethacrylate and 2-hydroxy-1,3-diacryloxypropane; polyethylene glycol di(meth)acrylate; polypropylene polyethylene glycol di(meth)acrylates; and polyvinyl esters of polyvalent carboxylic acid, such as divinyl succinate, divinyl fumarate, vinyl/divinyl maleate, divinyl diglycolate, vinyl/divinyl itaconate, divinyl acetonedicarboxylate, divinyl glutarate, divinyl 3,3'-thiodipropionate, divinyl/trivinyl trans-aconitate, divinyl adipate, divinyl pimelate, divinyl suberate, divinyl azelate, divinyl sebacate, divinyl dodecanedioic acid and divinyl brassylate.

In the present invention, one of these crosslinking agents may be used alone, or two or more thereof may be used in combination. Among the crosslinking agents above, preferred as the crosslinking agent for use in the present invention are (meth)acrylic acid esters of linear polyhydric alcohol, such as butanediol methacrylate, hexanediol acrylate, octanediol methacrylate, decanediol acrylate and dodecanediol methacrylate; (meth)acrylic acid esters of branched, substituted polyhydric alcohol, such as neopentyl glycol dimethacrylate and 2-hydroxy-1,3-diacryloxypropane; polyethylene glycol di(meth)acrylate; and polypropylene polyethylene glycol di(meth)acrylates.

The content of the crosslinking agent is preferably from 0.05 to 5 wt %, more preferably from 0.1 to 1.0 wt %, based on the total amount of polymerizable monomers.

Out of the addition polymerization resins for use in the toner of the present invention, those that can be produced by radical polymerization of a polymerizable monomer may be polymerized using a radical polymerization initiator.

The radical polymerization initiator used here is not particularly limited. Specific examples thereof include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, tert-butylhydroperoxide pert-riphenylacetate, tert-butyl performate, tert-butyl peracetate, tert-butyl perbenzoate, tert-butyl perphenylacetate, tert-butyl permethoxyacetate and tert-butyl per-N-(3-toluoyl)carbamate; azo compounds such as 2,2'-azobispropane, 2,2'-dichloro-2,2'-azobispropane, 1,1'-azo(methylethyl)diacetate, 2,2'-azobis(2-amidinopropane) hydrochloride, 2,2'-azobis(2-amidinopropane) nitrate, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(sodium 1-methylbutyronitrile-3-sulfonate), 2-(4-methylphenylazo)-2-methylmalonodinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1,1'-azobis-1,2-diphenylethane, poly(bisphenol A-4,4'-azobis-4-cyanopentanoate) and poly(tetraethylene glycol-2,2'-azobisisobutyrate); 1,4-bis(pentaethylene)-2-tetrazene; and 1,4-dimethoxycarbonyl-1,4-diphenyl-2-tetrazene.

The amount of the radical polymerization initiator used is preferably from 0.01 to 15 wt %, more preferably from 0.1 to 10 wt %, based on the total amount of polymerizable monomers.

The weight average molecular weight of the addition polymerization resin usable in the present invention is preferably from 1,500 to 60,000, more preferably from 3,000 to 40,000. When the weight average molecular weight is 1,500 or more, this is preferred because the cohesive force of the binder resin is not reduced and good property in terms of hot offset is obtained, and when the weight average molecular weight is 60,000 or less, good property in terms of hot offset is obtained and at the same time, the minimum fixing temperature is advantageously not raised.

As to the monomer for forming the polycondensation resin having a sea-island structure, for example, a polyvalent carboxylic acid having two or more carboxy groups within one molecule, or a polyhydric alcohol having two or more hydroxyl groups within one molecule may be used.

Examples of the polyvalent carboxylic acid include oxalic acid, glutaric acid, succinic acid, maleic acid, adipic acid, β-methyladipic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1,2-carboxylic acid, malic acid, citric acid, hexahydroterephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid and 1,4-cyclohexanedicarboxylic acid.

Examples of the polyvalent carboxylic acid other than the dicarboxylic acid include trimellitic acid, pyromellitic acid, naphthalenetricarboxylic acid, naphthalenetetracarboxylic acid, pyrenetricarboxylic acid and pyrenetetracarboxylic acid. Also, those where the carboxy group of these carboxylic acids is derived to an acid anhydride, a mixed acid anhydride, an acid chloride, an ester or the like may be used.

Examples of the polyhydric alcohol include ethylene glycol, diethylene glycol, triethylene glycol, 1,2-propylene glycol, 1,3-propylene glycol, 1,4-butanediol, 1,4-butenediol, neopentyl glycol, 1,5-pentane glycol, 1,6-hexane glycol, 1,4-cyclohexanediol, 1,4-cyclohexanedimethanol, dipropylene glycol, polyethylene glycol, polypropylene glycol, polytetramethylene glycol, bisphenol A, bisphenol Z, hydrogenated bisphenol A, cyclohexanedimethanol, and alkylene oxide adducts of these alcohols.

A crystalline polycondensation resin is obtained by the combination of the polyvalent carboxylic acid and the polyhydric alcohol, and examples of this polycondensation resin include a polyester obtained by reacting 1,9-nonanediol with 1,10-decanedicarboxylic acid, or cyclohexanediol with adipic acid, a polyester obtained by reacting 1,6-hexanediol with sebacic acid, a polyester obtained by reacting ethylene glycol with succinic acid, a polyester obtained by reacting ethylene glycol with sebacic acid, and a polyester obtained by reacting 1,4-butanediol with succinic acid.

As to the polyvalent carboxylic acid used for obtaining a noncrystalline polyester for use in the present invention, out of the polyvalent carboxylic acids above, examples of the dicarboxylic acid include phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid and cyclohexanedicarboxylic acid. Examples of the polyvalent carboxylic acid other than the dicarboxylic acid include trimellitic acid, pyromellitic acid, naphthalene-tricarboxylic acid, naphthalenetetracarboxylic acid, pyrenetricarboxylic acid and pyrenetetracarboxylic acid. Also, those where the carboxy group of these carboxylic acids is derived to an acid anhydride, an acid chloride, an ester or the like may be used.

Among these, preferred are terephthalic acid or a lower ester thereof, diphenylacetic acid and 1,4-cyclohexanedicarboxylic acid. Incidentally, a lower ester indicates an ester of an aliphatic alcohol having a carbon number of 1 to 8.

As to the polyhydric alcohol used for obtaining the noncrystalline polyester for use in the present invention, out of the polyhydric alcohols above, polytetramethylene glycol, bisphenol A, bisphenol Z, hydrogenated bisphenol A, cyclohexanedimethanol, and alkylene oxide adducts of these alcohols are particularly preferred.

A noncrystalline resin or crystalline resin can be easily obtained by the combination of the polycondensable monomers above.

For producing one kind of a polycondensation resin, one of those polyvalent carboxylic acids and one of those polyhydric alcohol may be used, one species may be used for one party, while using two or more species for another party, or two or more species may be used for each party. Also, in the case of using a hydroxycarboxylic acid for producing one kind of a polycondensation resin, one species may be used alone, two or more species may be used, or a polyvalent carboxylic acid and a polyhydric alcohol may be used in combination.

In many cases, control of the glass transition temperature is governed mainly by how high density a rigid unit such as aromatic ring or cyclohexane ring is incorporated into the main chain repeating unit of the polycondensation resin. Furthermore, when the density of the side chain such as aliphatic is raised, the glass transition temperature lowers. That is, the glass transition temperature lowers when the density of methylene group, ethylene group, oxyethylene group or the like in the main chain is high, and the glass transition temperature rises when the density of an aromatic ring, a cyclohexane ring or the like is increased. By taking these characteristics into consideration, a polycondensation resin having various glass transition temperatures can be obtained.

In the polycondensation reaction for producing the polycondensation resin, a polycondensation catalyst is preferably used, because the rate of reaction can be increased.

In the polycondensation reaction, the reaction is preferably performed at a temperature lower than the conventional reaction temperature, and this is very important so as to avoid the conventional high energy consumption-type production method and totally reduce the resin production energy and toner production energy.

The reaction temperature at the polycondensation is preferably 150° C. or less, more preferably from 70 to 150° C., still more preferably from 70 to 140° C., yet still more preferably from 80 to 140° C.

When the reaction temperature is 70° C. or more, high solubility of the monomer and sufficient catalytic activity as well as excellent reactivity are ensured and a resin having a high molecular weight can be advantageously obtained, and when the reaction temperature is 150° C. or less, this is preferred because the energy consumption can be kept low and neither coloration of the resin nor decomposition of the polycondensation resin produced occurs due to a high temperature.

The reaction time at the polycondensation may vary depending on the reaction temperature but is preferably from 0.5 to 72 hours, more preferably from 1 to 48 hours.

In order to polycondense the polycondensable monomer at a low temperature of preferably 150° C. or less (more preferably 100° C. or less), a polycondensation catalyst is preferably used. Examples of the polycondensation catalyst exhibiting catalytic activity at a low temperature include a sulfur acid, a metal catalyst, other acid-based catalysts, other rear earth-containing catalysts and a hydrolase. Among these, a sulfur acid is preferred.

Preferred examples of the sulfur acid include an inorganic sulfur acid and an organic sulfur acid. Examples of the inorganic sulfur acid include sulfuric acid, sulfurous acid and salts thereof. Examples of the organic sulfur acid include sulfonic acids such as alkylsulfonic acid, arylsulfonic acid and salts thereof, and organic sulfuric acids such as alkylsulfuric acid, arylsulfuric acid and salts thereof.

The sulfur acid is preferably an organic sulfur acid, more preferably an organic sulfur acid having a surface active effect. The acid having a surface active effect is a compound having both an emulsifying function and a catalytic function, which has an acid structure having a chemical structure composed of a hydrophobic group and a hydrophilic group, with at least a part of the hydrophilic group being composed of a proton.

Examples of the organic sulfur acid having a surface active effect include an alkylbenzenesulfonic acid, an alkylsulfonic acid, an alkyldisulfonic acid, an alkylphenolsulfonic acid, an alkylnaphthalenesulfonic acid, an alkyltetralinsulfonic acid, an alkylallylsulfonic acid, a petroleum sulfonic acid, an alkylbenzimidazolesulfonic acid, a higher alcohol ether sulfonic acid, an alkyldiphenylsulfonic acid, a long-chain alkylsulfuric acid ester, a higher alcohol sulfuric ester, a higher alcohol ether sulfuric acid ester, a higher fatty acid amide alkylolsulfuric acid ester, a higher fatty acid amide alkylated sulfuric acid ester, a sulfated fat, a sulfosuccinic acid ester, a resin acid alcohol sulfuric acid, and salt compounds of all of these acids. A plurality thereof may be used in combination, if desired. Above all, a sulfonic acid having an alkyl group or an aralkyl group, a sulfuric acid ester having an alkyl group or an aralkyl group, and a salt compound thereof are preferred, and the alkyl group or aralkyl group more preferably has a carbon umber of 7 to 20. Specific examples thereof included dodecylbenzenesulfonic acid, isopropylbenzenesulfonic acid, comphorsulfonic acid, p-toluenesulfonic acid, monobutylphenylphenol sulfuric acid, dibutyl-phenylphenol sulfuric acid, dodecylsulfuric acid and naphthenyl alcohol sulfuric acid.

Examples of the metal catalyst include, but are not limited to, an organotin compound, an organic titanium compound and an organic tin halide compound.

As for other acid-based catalysts, those exhibiting Broensted acidity are preferred, and examples thereof include a hydrochloric acid, a nitric acid, a phosphoric acid and a carboxylic acid.

Furthermore, an acid having a surface active effect may also be used. The acid having a surface active effect is a compound which has an acid structure having a chemical structure composed of a hydrophobic group and a hydrophilic group, with at least a part of the hydrophilic group being composed of a proton.

Other examples of the acid having a surface active effect include various fatty acids, a sulfonated higher fatty acid, a higher alkylphosphoric acid ester, a resin acid, a naphthenic acid, and salt compounds of all of these acids or esters, and a plurality thereof may be used in combination, if desired.

As for the rare earth-containing catalyst, those containing scandium (Sc), yttrium (Y), lanthanum (La) as lanthanoid element, cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), lutetium (Lu) or the like are effective. In particular, those having an alkylbenzenesulfonate, alkylsulfuric ester salt or triflate structure are effective.

The rare earth-containing catalyst is preferably a rare earth-containing catalyst having a triflate structure, such as scandium triflate, yttrium triflate and lanthanoid triflate. The lanthanoid triflate is described in detail in Journal of Synthetic Organic Chemistry, Japan, Vol. 53, No. 5, pp. 44-54. Examples of the structural formula of the triflate include $X(OSO_2CF_3)_3$, wherein X is a rare earth element. Above all, X is preferably scandium (Sc), yttrium (Y), ytterbium (Yb), samarium (Sm) or the like.

The hydrolase is not particularly limited as long as it catalyzes an ester synthesis reaction. Examples of the hydrolase include an esterase classified into EC (enzyme code) group 3.1 (see, for example, Maruo and Tamiya (supervisors), Koso Handbook (Handbook of Enzyme), Asakura-Shoten (1982)) such as carboxyesterase, lipase, phospholipase, acetylesterase, pectinesterase, cholesterol esterase, tannase, monoacylglycerol lipase, lactonase and lipoprotein lipase; a hydrolase classified into EC group 3.2 having activity on a glycosyl compound, such as glucosidase, galactosidase, glucuronidase and xylosidase; a hydrolase classified into EC group 3.3 such as epoxide hydrase; a hydrolase classified into EC group 3.4 having activity on a peptide bond, such as aminopeptidase, chymotrypsin, trypsin, plasmin and subtilisin; and a hydrolase classified into EC group 3.7, such as phloretin hydrase.

Out of these esterases, an enzyme that hydrolyzes a glycerol ester and isolates a fatty acid is called a lipase. The lipase is advantageous in that, for example, this enzyme shows high stability in an organic solvent, catalyzes an ester synthesis reaction with good efficiency and is inexpensive. Accordingly, from the aspect of yield and cost, a lipase is preferably used also in the production process of a polyester of the present invention.

Lipases of various origins may be used, but preferred examples thereof include a lipase obtained from microorganisms of genus *Pseudomonas*, genus *Alcaligenes*, genus *Achromobacter*, genus *Candida*, genus *Aspergillus*, genus *Rhizopus* and genus *Mucor*, a lipase obtained from plant seeds, a lipase obtained from animal tissues, pancreatin and steapsin. Among these, a lipase originated in the microorganisms of genus *Pseudomonas*, genus *Candida* and genus *Aspergillus* is preferred.

One of these polycondensation catalysts may be used alone or a plurality thereof may be used in combination. Furthermore, such a catalyst may be recovered and regenerated, if desired.

The amount of the polycondensation catalyst is preferably from 0.01 to 10 wt %, more preferably from 0.1 to 5 wt %, based on the total amount of polycondensable monomers.

The polycondensation resin may be produced by a known polycondensation process such as bulk polymerization, emulsion polymerization, hydropolymerization (e.g., suspension polymerization), solution polymerization or interfacial polymerization, but a bulk polycondensation process is preferred. Also, the reaction may be performed under atmospheric pressure, but in the case of producing a high molecular weight polycondensation resin such as polyester, general conditions such as reduced pressure and nitrogen stream can be widely employed.

The polycondensation reaction or the polymerization reaction described later may be performed using an aqueous medium.

Examples of the aqueous medium which can be used in the present invention include water such as distilled water and ion exchanged water, and alcohols such as ethanol and methanol. Among these, ethanol and water are preferred, and water such as distilled water and ion exchanged water is more preferred. One of these aqueous mediums may be used alone, or two or more thereof may be used in combination.

Also, the aqueous medium may contain a water-miscible organic solvent. Examples of the water-miscible organic solvent include acetone and acetic acid.

The polycondensation reaction or the polymerization reaction described later may be performed using an organic solvent.

Specific examples of the organic solvent which can be used in the present invention include a hydrocarbon-based solvent such as toluene, xylene, mesitylene; a halogen-based solvent such as chlorobenzene, bromobenzene, iodobenzene, dichlorobenzene, 1,1,2,2-tetrachloroethane and p-chlorotoluene; a ketone-based solvent such as 3-hexanone, acetophenone and benzophenone; an ether-based solvent such as dibutyl ether, anisole, phenetole, o-dimethoxybenzene, p-dimethoxybenzene, 3-methoxytoluene, dibenzyl ether, benzyl phenyl ether, methoxynaphthalene and tetrahydrofuran; a thioether solvent such as phenyl sulfide and thioanisole; an ester-based solvent such as ethyl acetate, butyl acetate, pentyl acetate, methyl benzoate, methyl phthalate, ethyl phthalate and cellosolve acetate; and a diphenyl ether-based solvent such as diphenyl ether, an alkyl-substituted diphenyl ether (e.g., 4-methyl phenyl ether, 3-methyl phenyl ether, 3-phenoxytoluene), a halogen-substituted diphenyl ether (e.g., 4-bromophenyl ether, 4-chlorophenyl ether, 4-bromodiphenyl ether, 4-methyl-4'-bromodiphenyl ether), an alkoxy-substituted diphenyl ether (e.g., 4-methoxydiphenyl ether, 4-methoxyphenyl ether, 3-methoxyphenyl ether, 4-methyl-4'-methoxydiphenyl ether), and a cyclic diphenyl ether (e.g., dibenzofuran, xanthene). Some of these solvents may be mixed and used. The solvent is preferably a solvent easily separable from water and for obtaining a polycondensation resin having a high average molecular weight, more preferably an ester-based solvent, an ether-based solvent or a diphenyl ether-based solvent, still more preferably an alkyl-aryl ether-based solvent or an ester-based solvent.

Furthermore, in the present invention, in order to obtain a polycondensation resin having a high average molecular weight, a dehydrating demonomerizing agent may be added to the organic solvent. Specific examples of the dehydrating demonomerizing agent include molecular sieves such as molecular sieve 3A, molecular sieve 4A, molecular sieve 5A and molecular sieve 13X, alumina, silica gel, calcium chloride, calcium sulfate, diphosphorus pentoxide, concentrated sulfuric acid, magnesium perchlorate, barium oxide, calcium oxide, potassium hydroxide, sodium hydroxide, a metal hydride such as calcium hydride, sodium hydride and lithium aluminum hydride, and an alkali metal such as sodium. Among these, molecular sieves are preferred in view of easiness of handling and regeneration.

The weight average molecular weight of the polycondensation resin which can be used in the present invention is preferably from 1,500 to 60,000, more preferably from 3,000 to 40,000. The weight average molecular weight is preferably 1,500 or more, because the cohesive force of the binder resin does not decrease and the property in terms of hot offset is good. Also, the weight average molecular weight is preferably 60,000 or less, because the property in terms of hot offset is good and the minimum fixing temperature is not raised. The resin may be partially branched or crosslinked by, for example, selecting the carboxylic acid valence or alcohol valence of monomers.

In the present invention, the polycondensation step may contain a polymerization reaction of a polyvalent carboxylic acid and a polyhydric alcohol, which are polycondensation components described above, with a previously produced prepolymer.

The prepolymer is not limited as long as it is a polymer capable of being melted or uniformly mixed in the monomers above. Furthermore, the binder resin for use in the present invention may contain, for example, a homopolymer of the above-described polycondensation component, a copolymer combining two or more monomers containing the above-described polycondensation components, or a mixture, graft polymer, partially branched or crosslinked structure thereof.

In the present invention, in the case of polymerizing a polycondensable monomer and a radical polymerizable monomer, the radical polymerizable monomer may be previously mixed with the polycondensable monomer at the polymerization step in an aqueous medium to finally produce a hybrid particle of the polymer thereof through polycondensation and radical polymerization.

Furthermore, in the polycondensation reaction, it is also possible to previously form a polymer having a low molecular weight, for example, by a block polymerization process or a solution polymerization process, emulsify or disperse the polymer in an aqueous medium, and perform a polycondensation reaction to reach the final molecular weight. Also in this case, emulsion-dispersion may be performed after mixing a radical polymerizable monomer with the low molecular weight polycondensable resin or with the low molecular weight polycondensable resin and the polycondensable monomer.

In the polycondensation and/or polymerization in an aqueous medium of the present invention, the acid value of the resin affects the final molecular weight or the polymerization rate and therefore, a method of causing a radical polymerizable vinyl monomer or the like having low solubility in an aqueous medium to coexist during polycondensation, a method of previously preparing a polycondensable monomer in a low molecular weight form (or a medium molecular weight form) to such an extent as to cause no trouble in the emulsification and dispersion and after adjusting the acid value to a lower state, obtaining a final high molecular weight form in an aqueous medium, or a method using these two methods in combination, that is, a method where preliminary polymerization processes of a radical polymerizable monomer and a polycondensable monomer are used in combination, may also be employed.

Similarly, in the polymerization of the present invention, a plurality of polymerizations may be performed simultaneously or successively. For example, a radical polymerizable monomer as a monomer component for undergoing polymerization may be mixed together with polycondensable monomers, and radical polymerization may be performed simultaneously with or after the polycondensation reaction, or inversely, the polycondensation reaction may be performed after radical polymerization. At this time, a polycondensation catalyst may be added in the aqueous medium or the monomer component. Also, a radical polymerization catalyst (radical polymerization initiator) may be added in the monomer mixture (oil phase) or the aqueous medium. Furthermore, the radical polymerization initiator may be added before, during or after polycondensation.

At the polycondensation or polymerization in an aqueous medium of the present invention, monomer components before polycondensation may also be previously mixed with a colorant, a fixing aid such as release agent, and other components generally required in the polymerization reaction or the production of toner, such as electrification aid and chain extender.

In the case of performing the polycondensation and/or polymerization in an aqueous medium at the production of the binder resin, examples of the method for forming a monomer particle emulsion include a method where a monomer solution having added thereto a co-surfactant (oil phase) and an aqueous medium solution of surfactant (aqueous phase) are uniformly mixed and emulsified in a shear mixing apparatus such as piston homogenizer, microfluidizing device (e.g., "Microfluidizer" manufactured by Microfluidics) or ultrasonic disperser. At this time, the amount of the oil phase charged in the aqueous phase is preferably on the order of 0.1 to 50 wt % based on the total amount of the aqueous phase and the oil phase. The amount of the surfactant used is preferably less than the critical micelle concentration (CMC) in the presence of the emulsion formed. Also, the amount of the co-surfactant used is preferably from 0.1 to 40 parts by weight, more preferably from 0.1 to 20 parts by weight, per 100 parts by weight of the oil phase.

Incidentally, a "miniemulsion polymerization process", which is a process of polymerizing the monomer of a monomer emulsion in the presence of a polymerization initiator by using a surfactant in an amount less than the critical micelle concentration (CMC) and a co-surfactant in combination, is preferred because an addition-polymerizable monomer is polymerized within a monomer particle (oil droplet) and a uniform polymer particle is formed. Furthermore, in the present invention, the "miniemulsion polymerization process" is advantageous also for the polymerization of a polycondensation/addition-polymerization composite polymer, because the monomer need not diffuse in the course of polymerization and the polycondensation polymer can be present as it is in the polymer particle.

A so-called "microemulsion polymerization process" of producing particles having a particle diameter of 5 to 50 nm described, for example, in J. S. Guo, M. S. El-Aasser and J. W. Vanderhoff, J. Polym. Sci.: Polym. Chem. Ed., Vol. 27, page 691 (1989) has the same dispersion structure and the same polymerization mechanism as those of the "miniemulsion polymerization process" referred to in the present invention and can be employed in the present invention. In the "microemulsion polymerization", a surfactant is used in a large amount more than the critical micelle concentration (CMC) and this may cause a problem that, for example, a large amount of surfactant is mingled in the obtained polymer particle or a huge time is required in the step for removing the surfactant, such as water washing, acid washing or alkali washing.

In the case of performing the polycondensation and/or polymerization in an aqueous medium at the production of the binder resin, a co-surfactant is preferably used. The co-surfactant is more preferably used in an amount of 0.1 to 40 wt % based on the total amount of monomers. The co-surfactant is added to reduce the Ostwald ripening in the so-called miniemulsion polymerization. As for the co-surfactant, those generally known as a co-surfactant for the miniemulsion process may be used.

Suitable examples of the co-surfactant include, but are not limited to, alkanes having a carbon number of 8 to 30, such as dodecane, hexadecane and octadecane; alkyl alcohols having a carbon number of 8 to 30, such as lauryl alcohol, cetyl alcohol and stearyl alcohol; alkyl mercaptans having a carbon number of 8 to 30, such as lauryl mercaptan, cetyl mercaptan and stearyl mercaptan; acrylic acid esters, methacrylic acid esters, and polymers thereof; polymers or polyadducts such as polystyrene and polyester; carboxylic acids; ketones; and amines.

Among these co-surfactants, preferred are hexadecane, cetyl alcohol, stearyl methacrylate, lauryl methacrylate, polyester and polystyrene. In particular, for the purpose of avoiding the generation of a volatile organic substance, stearyl methacrylate, lauryl methacrylate, polyester and polystyrene are more preferred.

The polymer or polymer-containing composition which can be used for the co-surfactant may contain, for example, a copolymer, block copolymer or mixture with another monomer. Furthermore, a plurality of co-surfactants may also be used in combination.

The co-surfactant may be added in the oil phase or the aqueous phase.

In the production of the toner of the present invention, a surfactant may be used, for example, for the purpose of stabilization at the dispersion in the suspension polymerization process or for stabilizing the dispersion of a resin particle liquid dispersion, a colorant liquid dispersion, a release agent liquid dispersion or the like in the emulsion-polymerization aggregation process.

Examples of the surfactant include an anionic surfactant such as sulfuric ester salt type, sulfonate type, phosphoric ester type and soap type; a cationic surfactant such as amine salt type and quaternary ammonium salt type; and a nonionic surfactant such as polyethylene glycol type, alkyl phenol ethylene oxide adduct type and polyhydric alcohol type. Among these, an ionic surfactant is preferred, and an anionic surfactant and a cationic surfactant are more preferred.

In the toner of the present invention, an anionic surfactant generally exerts strong dispersion force and provides excellent dispersion of resin particles or a colorant. Also, an anionic surfactant is advantageous as the surfactant for dispersing a release agent.

The nonionic surfactant is preferably used in combination with the above-described anionic or cationic surfactant. One of those surfactants may be used alone, or two or more thereof may be used in combination.

Specific examples of the anionic surfactant include fatty acid soaps such as potassium laurate, sodium oleate and sodium castor oil; sulfuric acid esters such as octyl sulfate, lauryl sulfate, lauryl ether sulfate and nonyl phenyl ether sulfate; sodium alkylnaphthalenesulfonates such as lauryl sulfonate, dodecylbenzene sulfonate, triisopropylnaphthalene sulfonate and dibutylnaphthalene sulfonate; sulfonates such as naphthalene sulfonate formalin condensate, monooctyl sulfosuccinate, dioctyl sulfosuccinate, lauric acid amide sulfonate and oleic acid amide sulfonate; phosphoric acid esters such as lauryl phosphate, isopropyl phosphate and nonyl phenyl ether phosphate; dialkyl sulfosuccinates such as sodium dioctylsulfosuccinate; and sulfosuccinates such as disodium lauryl sulfosuccinate.

Specific examples of the cationic surfactant include amine salts such as laurylamine hydrochloride, strearylamine hydrochloride, oleylamine acetate, stearylamine acetate and stearylaminopropylamine acetate; and quaternary ammonium salts such as lauryltrimethylammonium chloride, dilauryldimethylammonium chloride, distearyldimethylammonium chloride, distearyldimethylammonium chloride, lauryldihydroxyethylmethylammonium chloride, oleylbispolyoxy-ethylenemethylammonium chloride, lauroylaminopropyl-dimethylethylammonium ethosulfate, lauroylaminopropyl-dimethylhydroxyethylammonium perchlorate, alkylbenzene-trimethylammonium chloride and alkyltrimethylammonium chloride.

Specific examples of the nonionic surfactant include alkyl ethers such as polyoxyethylene octyl ether, polyoxyethylene lauryl ether, polyoxyethylene stearyl ether and polyoxyethylene oleyl ether; alkyl phenyl ethers such as polyoxyethylene octyl phenyl ether and polyoxyethylene nonyl phenyl ether; alkyl esters such as polyoxyethylene laurate, polyoxyethylene stearate and polyoxyethylene oleate; alkylamines such as polyoxyethylene laurylamino ether, polyoxyethylene stearylamino ether, polyoxyethylene oleylamino ether, polyoxyethylene soybean amino ether and polyoxyethylene beef tallow amino ether; alkyl amides such as polyoxyethylene lauric acid amide, polyoxyethylene stearic acid amide and polyoxyethylene oleic acid amide; vegetable oil ethers such as polyoxyethylene castor oil ether and polyoxyethylene rape-seed oil ether; alkanol-amides such as lauric acid diethanolamide, stearic acid diethanolamide and oleic acid-diethanolamide; and sorbitan ester ethers such as polyoxyethylene sorbitan monolaurate, polyoxyethylene sorbitan monopalmitate, polyoxyethylene sorbitan monostearate and polyoxyethylene sorbitan monooleate.

The content of the surfactant in each liquid dispersion is sufficient if it is on the order of not inhibiting the present invention. Specifically, the surfactant content is preferably from 0.01 to 3 wt %, more preferably from 0.05 to 2 wt %, still more preferably from 0.1 to 2 wt %. When the surfactant content is in this range, the liquid dispersions such as resin particle liquid dispersion, colorant liquid dispersion and release agent liquid dispersion each can be stable, aggregation or isolation of a specific particle does not occur, the amount added of the calcium compound is not affected, and the effects of the present invention can be satisfactorily obtained. In general, a suspension-polymerization toner dispersion having a large particle diameter is stable even when the amount of the surfactant used is small.

As for the dispersion stabilizer used in the suspension polymerization method and the like, a sparingly water-soluble hydrophilic inorganic powder may be used. Examples of the inorganic powder which can be used include silica, alumina, titania, calcium carbonate, magnesium carbonate, tricalcium phosphate (hydroxyapatite), clay, diatomaceous earth and bentonite. Among these, calcium carbonate and tricalcium phosphate are preferred in view of facilitated particle size formation and easy removal of the particle.

An aqueous polymer or the like which is solid at ordinary temperature may also be used as the dispersion stabilizer. Specific examples of the aqueous polymer which can be used include a cellulose-based compound such as carboxymethylcellulose and hydroxypropylcellulose, polyvinyl alcohol, gelatin, starch, and gum arabic.

For forming an island phase having a major axis of about 150 nm or less, an aggregated and fused particle needs to be formed using a resin particle finer than those used in a normal toner production method by aggregation. Examples of the method for adjusting the median diameter of resin particles include a method of adjusting the amount of a surfactant used at the emulsification and dispersion.

The median diameter of each resin particle of the high Tg resin and the low Tg resin is, as a resin particle dispersion of raw material, about 100 nm or less, preferably from about 10 nm to about 90 nm, more preferably from about 40 nm to about 80 nm. If the median diameter of the resin particle exceeds 100 nm, the major axis of the island phase contained in the toner exceeds 150 nm to decrease the fixability. When the median diameter of the resin particle is 10 nm or more, a sea-island structure is successfully formed without allowing progress of mixing and dissolution at the aggregation and fusing and the resin is advantageously free from plasticization at ordinary temperature.

The median diameter of the resin particle can be measured by a known method and may be measured, for example, by a laser diffraction-type particle size distribution measuring device (LA-920, manufactured by Horiba Ltd.).

<Electrostatic Charge Controlling Agent>

In the toner of the present invention, an electrostatic charge controlling agent may be added, if desired.

As for the electrostatic charge controlling agent, a known material may be used, but an azo-based metal complex compound, a metal complex compound of salicylic acid, or a polar group-containing resin-type electrostatic charge controlling agent can be used. In the case of producing the toner by a wet production process, a material hardly soluble in water is preferably used in view of control of ion intensity (%) and reduction of waste water pollution. Incidentally, the toner of the present invention may be either a magnetic material-containing magnetic toner or a magnetic material-free nonmagnetic toner.

<Colorant>

The colorant which can be used in the present invention is not particularly limited, and known colorants may be used. An appropriate colorant may be selected according to the purpose. One kind of a colorant may be used alone, two or more kinds of colorants of the same series may be mixed and used, or two or more kinds of colorants of different series may be mixed and used. Such a colorant may be surface-treated before use.

Specific examples of the colorant include the following black, yellow, orange, red, blue, violet, green and white-type colorants.

Examples of the black pigment include organic or inorganic colorants such as carbon black, aniline black, active carbon, non-magnetic ferrite and magnetite.

Examples of the yellow pigment include chrome yellow, zinc yellow, yellow calcium oxide, cadmium yellow, chromium yellow, Fast Yellow, Fast Yellow 5G, Fast Yellow 5GX, Fast Yellow 10G, Benzidine Yellow G, Benzidine Yellow GR, Threne Yellow, Quinoline Yellow and Permanent Yellow NCG.

Examples of the orange pigment include red chrome yellow, Molybdenum Orange, Permanent Orange GTR, Pyrazolone Orange, Vulcan Orange, Benzidine Orange G, Indantherene Brilliant Orange RK and Indantherene Brilliant Orange GK.

Examples of the red pigment include iron oxide red, cadmium red, red lead, mercury sulfide, Watchung Red, Permanent Red 4R, Lithol Red, Brilliant Carmine 3B, Brilliant Carmine 6B, DuPont Oil Red, pyrazolone red, Rhodamine B Lake, Lake Red C, Rose Bengal, Eoxine Red and Alizarin Lake.

Examples of the blue pigment include organic or inorganic colorants such as Prussian Blue, cobalt blue, Alkali Blue Lake, Victoria Blue Lake, Fast Sky Blue, Indanthrene Blue BC, Ultramarine Blue, Phthalocyanine Blue and Phthalocyanine Green.

Examples of the violet pigment include organic or inorganic colorants such as manganese violet, Fast Violet B and Methyl Violet Lake.

Examples of the green pigment include organic or inorganic colorants such as chromium oxide, chromium green, Pigment Green B, Malachite Green Lake and Final Yellow Green G.

Examples of the white pigment include zinc white, titanium oxide, antimony white and zinc sulfide.

Examples of the extender pigment include barite powder, barium carbonate, clay, silica, white carbon, talc and white alumina.

The colorant for use in the toner of the present invention may be dispersed in the binder resin by using a known method. In the case of a toner produced by a kneading pulverization method, the colorant may be used as it is, or a so-called masterbatch prepared by previously dispersing the colorant in a resin to a high concentration and kneading it together with the binder resin at the kneading may be used. Furthermore, a flushing process where a colorant synthesized still in the wet cake state before drying is dispersed in a resin may also be employed.

The colorant may be used as it is for the production of the toner by a suspension polymerization method. In the suspension polymerization method, the colorant dispersed in a resin is dissolved or dispersed in the polymerizable monomer, whereby the colorant can be dispersed in the granulated particle.

In the case of a toner produced by an emulsion-polymerization aggregation method, the colorant is dispersed together with a dispersant such as surfactant in an aqueous medium by using mechanical impact or the like to prepare a colorant liquid dispersion, and the colorant liquid dispersion is aggregated together with a resin particle and the like, whereby the toner can be obtained.

In dispersing the colorant by mechanical impact or the like, a colorant particle liquid dispersion may be prepared specifically, for example, by using a rotary shear homogenizer, a media-type disperser such as ball mill, sand mill and attritor, or a high-pressure counter-collision disperser. The colorant may also be dispersed in an aqueous system by a homogenizer with use of a surfactant having polarity.

In order to ensure coloration at the fixing, the colorant is preferably added in an amount of 5 to 20 wt %, more preferably from 5 to 15 wt %, based on the total weight as a solid content of the toner. However, in the case of using a magnetic material as the black colorant, the colorant is preferably added in the range from 12 to 48 wt %, more preferably from 15 to 40 wt %. By appropriately selecting the kind of the colorant, a color toner such as yellow toner, magenta toner, cyan toner, black toner, white toner and green toner can be obtained.

<Release Agent>

In the toner of the present invention, a release agent may be added, if desired, but in a preferred embodiment of the present invention, a release agent is not added.

The release agent is generally used for enhancing the releasability.

Specific examples of the release agent include low molecular weight polyolefins such as polyethylene, polypropylene and polybutene; silicones exhibiting a softening point under heating; fatty acid amides such as oleic acid amide, erucic acid amide, ricinoleic acid amide and stearic acid amide; vegetable waxes such as carnauba wax, rice wax, candelilla wax, Japan wax and jojoba oil; animal waxes such as bees wax; mineral or petroleum waxes such as montan wax, ozokerite, ceresin, paraffin wax, microcrystalline wax and Fischer-Tropsch wax; and ester-based waxes such as fatty acid ester, montanic acid ester and carboxylic acid ester. In the present invention, one of these release agents may be used alone, or two or more thereof may be used in combination.

The amount of the release agent added is preferably from 1 to 20 wt %, more preferably from 5 to 15 wt %, based on the total amount of toner particles. The amount added in this range is preferred, because the effect of the release agent is sufficiently exerted and the toner particle is not easily broken in a developing machine, ensuring that the release agent is not spent on a carrier and the electric charge scarcely decreases.

<Magnetic Material>

The toner of the present invention may contain a magnetic material, if desired.

The magnetic material includes a metal exhibiting ferromagnetic property, such as iron (including ferrite and magnetite), cobalt and nickel, an alloy or compound containing such an element; an alloy which contains no ferromagnetic element but exhibits ferromagnetic property when subjected to an appropriate heat treatment, for example, an alloy of the type called Heusler alloy containing manganese and copper, such as manganese-copper-aluminum and manganese-copper-tin; chromium dioxide; and others. For example, in the case of obtaining a black toner, magnetite that is black in itself and also exerts a function as the colorant may be preferably used. In the case of obtaining a color toner, a magnetic material with less black tinting, such as metallic iron, is preferred. Some of these magnetic materials also fulfill a function as the colorant and in such a case, the magnetic material may be used to serve also as a colorant. The content of the magnetic material is, in the case of producing a magnetic toner, preferably from 20 to 70 parts by weight, more preferably from 40 to 70 parts by weight, per 100 parts by weight of the toner.

<Internal Additive>

In the toner of the present invention, an internal additive may be added to the inside of the toner. The internal additive is generally used for the purpose of controlling the viscoelasticity of the fixed image.

Specific examples of the internal additive include an inorganic particle such as silica and titania, and an organic particle such as polymethyl methacrylate. The internal additive may be surface-treated for enhancing the dispersibility. One of these internal additives may be used alone, or two or more thereof may be used in combination.

<External Additive>

In the toner of the present invention, an external additive such as fluidizing agent and electrostatic charge controlling agent may be added.

As for the external additive, a known material may be used, and examples thereof include an inorganic particle surface-treated with a silane coupling agent or the like, such as silica particle, titanium oxide particle, alumina particle, cerium oxide particle and carbon black; a polymer particle such as polycarbonate, polymethyl methacrylate and silicone resin; an amine metal salt; and a salicylic acid metal complex. One of these external additives usable in the present invention may be used alone, or two or more thereof may be used in combination.

The accumulated volume average particle diameter $D_{50}$ of the toner of the present invention is preferably from 3.0 to 9.0 μm, more preferably from 3.0 to 5.0 μm. The $D_{50}$ is preferably 3.0 μm or more, because appropriate adhesive force and good developability are obtained, and $D_{50}$ is preferably 9.0 μm or less, because the image resolution is excellent.

Also, the volume average particle size distribution index GSDv of the toner of the present invention is preferably 1.30 or less. When GSDv is 1.30 or less, good resolution, less occurrence of toner flying, fogging or the like, and scarce production of image defect are advantageously ensured.

As for the accumulated volume average particle diameter $D_{50}$ or average particle size distribution index GSDv of the toner of the present invention, an accumulated distribution of each of the volume and the number is drawn from the small diameter side with respect to the particle size range (channel) divided on the basis of particle size distribution measured by a measuring device such as Coulter Counter TAII (manufactured by Beckman Coulter Inc.) or Multisizer II (manufactured by Beckman Coulter Inc.), and the particle diameter is defined as follows: the particle diameter at 16% accumulation is $D_{16v}$ by volume and $D_{16P}$ by number, the particle diameter at 50% accumulation is $D_{50v}$ by volume and $D_{50P}$ by number, and the particle diameter at 84% accumulation is defined as $D_{84v}$ by volume and $D_{84P}$ by number. Using these, the volume average particle size distribution index (GSDv) is calculated as $(D_{84v}/D_{16v})^{1/2}$ and the number average particle size distribution index (GSDp) is calculated as $(D_{84P}/D_{16P})^{1/2}$.

The shape factor SF1 of the toner is preferably from 110 to 140, more preferably from 120 to 140. In the electrophotographic process, it is known that a spherical toner is more easily transferred in the transfer step and an amorphous toner is more easily cleaned off in the cleaning step.

The SF1 is a shape factor showing the degree of irregularities on the toner particle surface and is calculated as follows. An optical micrograph of the toner scattered on a slide glass is imported into a Luzex image analyzer through a video camera, SF1 is calculated from the square of maximum toner particle length/projected area ($(ML)^2/A$) of 50 toner particles in accordance with the following equation, and the average value is determined, whereby the toner shape factor SF1 is obtained.

$$SF1 = \frac{(ML)^2}{A} \times \frac{\pi}{4} \times 100$$

wherein ML indicates the maximum length of toner particles and A indicates the projected area of particles.

II. Production Method of Electrostatic Image Developing Toner for Pressure Fixing The production method of an electrostatic image developing toner for pressure fixing of the present invention includes: a dispersing step of dispersing two kinds of resin particles in an aqueous medium, in which both of the two kinds of resin particles have a glass transition temperature of less than about 55° C. and a difference between the glass transition temperatures of the two kinds of resin particles is about 30° C. or more; an aggregating step of aggregating the two kinds of dispersed resin particles to obtain aggregated particles; and a fusing step of heating and fusing the aggregated particles to form a sea-island structure, wherein both of two kinds of resin particles have a median diameter of about 100 nm or less and an island phase contained in the sea-island structure has a major axis of about 150 nm or less.

As for the production method of the electrostatic image developing toner of the present invention, the toner may be produced by a so-called chemical production process of producing a resin particle liquid dispersion by using a binder resin, and producing a toner from the resin particle liquid dispersion.

The production method of the electrostatic image developing toner of the present invention is not particularly limited as long as it is a known method such as emulsion-polymerization aggregation method or suspension polymerization method, but above all, an emulsion-polymerization aggregation method is preferred.

The dispersing step above is a step of dispersing two kinds of resin particles in an aqueous medium, in which a difference between the glass transition temperatures of the two kinds of resin particles is about 30° C. or more and both of the two kinds of resin particles have a glass transition temperature of less than about 55° C., and it is preferred that a resin particle liquid dispersion, a colorant particle liquid dispersion and other binder resin particle liquid dispersions are separately prepared and these are mixed to disperse the resin particle and the like in an aqueous medium.

The method for producing a resin particle liquid dispersion may be selected from known methods such as forced emulsification method, self-emulsification method and phase inversion emulsification method. Among these, a self-emulsification method and a phase inversion emulsification method are preferably applied in view of energy necessary for emulsification, controllability of particle size of the emulsified product, stability and the like.

The self-emulsification method and phase inversion emulsification method are described in Cho-Biryusi Polymer no Oyo Gijutsu "Application Technology of Superfine Polymer Particles", CMC Publishing Co., Ltd.

In producing the resin particle liquid dispersion of the binder resin, an organic solvent may be used. In the case of using an organic solvent, the resin particle is preferably formed by removing a part of the organic solvent.

For example, the binder resin-containing material after emulsification is preferably solidified as a particle by removing a part of the organic solvent. Specific examples of the method for solidification include a method of emulsion-dispersing the resin-containing material in an aqueous medium and then drying the organic solvent at the air-liquid interface by feeding air or an inert gas such as nitrogen while stirring the solution (waste air drying method), a method of drying the solvent by keeping the system under reduced pressure while, if desired, bubbling an inert gas (vacuum topping method), and a method of discharging an emulsified liquid dispersion of the resin-containing material emulsified-dispersed in an aqueous medium or an emulsion of the resin-containing material from fine nozzles to fall on a dish-like receiver or the like, and drying the solvent while repeating this operation (shower-type solvent-removing method). The removal of solvent is preferably performed by appropriately selecting these methods individually or in combination according to the evaporation rate, solubility in water or the like of the organic solvent used.

The aggregation method in the aggregating step is not particularly limited, and a conventional aggregation method used in the emulsion-polymerization aggregation of an electrostatic image developing toner, for example, a method of reducing the stability of an emulsion by temperature rise, pH change, salt addition or the like and stirring it with a disperser or the like, may be used.

In order to stably and rapidly achieve aggregation of particle or obtain aggregated particles having a narrow particle size distribution, an aggregating agent may be added.

As for the aggregating agent, a compound having a monovalent or greater charge is preferred, and specific examples of the compound include the above-described water-soluble surfactants such as ionic surfactant and nonionic surfactant; acids such as hydrochloric acid, sulfuric acid, nitric acid, acetic acid and oxalic acid; metal salts of inorganic acid, such as magnesium chloride, sodium chloride, aluminum sulfate, calcium sulfate, ammonium sulfate, aluminum nitrate, silver nitrate and sodium carbonate; metal salts of aliphatic or aromatic acid, such as sodium acetate, potassium formate, sodium oxalate, sodium phthalate and potassium salicylate; metal salts of phenol, such as sodium phenolate; metal salts of amino acid; and inorganic acid salts of aliphatic or aromatic amine, such as triethanolamine hydrochloride and aniline hydrochloride.

In considering the stability of aggregated particles as well as stability against heat or aging or removability at washing of the aggregating agent, the aggregating agent is preferably a metal salt of inorganic acid in view of the performance and use. Specific examples of the metal salts of inorganic acid include magnesium chloride, sodium chloride, aluminum sulfate, ammonium sulfate, aluminum nitrate, silver nitrate, copper sulfate and sodium carbonate.

The amount of the aggregating agent added varies depending on the charge valence but is a small amount in any case and is about 3 wt % or less for a monovalent compound, about 1 wt % or less for a divalent compound, and about 0.5 wt % or less for a trivalent compound, based on the total amount of the toner. The amount of the aggregating agent is preferably small and therefore, use of a compound having a higher valence is preferred.

In the aggregating step, respective particles in the liquid dispersion of two kinds of resin particles both having a glass transition temperature of less than about 55° C., with the difference between the glass transition temperatures thereof being about 30° C. or more, and in the colorant liquid dispersion are aggregated, whereby aggregated particles having a toner particle diameter can be formed. The aggregated particles are formed by hetero-aggregation or the like and for the purpose of stabilizing the aggregated particles or controlling the particle size/particle size distribution, an ionic surfactant having polarity different from that of the aggregated particle or a compound having a monovalent or greater charge, such as metal salt, may be added.

In the aggregation step, the liquid dispersion of two kinds of resin particles both having a glass transition temperature of less than about 55° C., with the difference between the glass transition temperatures thereof being about 30° C. or more, is mixed with a colorant particle liquid dispersion and other binder resin particle liquid dispersions or the like and an aggregating agent is further added to cause heteroaggregation and form aggregated particles of a toner diameter. Thereafter, the aggregated particles are fused and coalesced under heating at a temperature at which resin particles and the like can be fused, and the fused particles are washed and dried, whereby toner particles can be obtained. In this production method, the toner shape can be controlled from amorphous to spherical by selecting the heating temperature condition.

In the aggregating step, the aggregation and subsequent steps may be performed after mixing the liquid dispersion of two kinds of resin particles both having a glass transition temperature of less than about 55° C., with the difference between the glass transition temperatures thereof being about 30° C. or more, and one or more kinds of other binder resin particle liquid dispersions. At this time, it is also possible to form a multilayer particle, for example, by previously aggregating the resin particle liquid dispersion to form a first aggregated particle and adding a resin particle liquid dispersion of high Tg resin or another binder resin particle liquid dispersion to form a second shell layer on the surface of the first aggregated particles. In the present invention, the second shell layer is preferably formed of a high Tg resin out of those two kinds of resin particles.

After the aggregation treatment, the particle surfaces may be crosslinked, for example, by applying a heat treatment so as to suppress leaching of the colorant out of the particle surface. The surfactant and the like employed therefor may be removed, if desired, by water washing, acid washing, alkali washing or the like.

The fusing step is a step of heating and fusing the aggregated particles obtained in the aggregating step to form a sea-island structure. In the fusing step, the binder resin in the aggregated particle is melted under the temperature condition of not lower than the melting point or glass transition temperature and the aggregated particle shape changes from amorphous to spherical. Thereafter, the aggregate is separated from the aqueous medium and, if desired, subjected to washing and drying, whereby toner particles are formed.

In order to maintain the sea-island structure in the toner, the binder resin is preferably melted under the condition of glass transition temperature of high Tg resin+50° C. If the binder resin is melted at excessively high temperature, coalescence of the sea phase and the island phase proceeds, failing in maintaining the microphase-separated structure, and the pressure plasticizing behavior sometimes becomes insufficient.

After the completion of dispersing, aggregating and fusing steps, a washing step, a solid-liquid separation step and a drying step may be arbitrarily performed to obtain a desired toner.

In the washing step, washing by thorough replacement with ion exchanged water is preferably applied in view of electrostatic property. The solid-liquid separation step is not particularly limited but in view of productivity, suction filtration, pressure filtration or the like is preferably used. The drying step is also not particularly limited but in view of productivity, freeze drying, flash jet drying, fluidized drying, vibration-type fluidized drying and the like are preferred.

In the production method of the electrostatic image developing toner of the present invention, mixing at high temperature under high pressure is preferably avoided for not collapsing the sea-island structure.

III. Electrostatic Image Developer

The electrostatic image developing toner for pressure fixing of the present invention may be used as an electrostatic image developer. This electrostatic image developer is not particularly limited except for containing the electrostatic image developing toner for pressure fixing of the present invention and may take an appropriate component composition according to the purpose. When the electrostatic image developing toner for pressure fixing is used alone, a one-component type electrostatic image developer is prepared, and when used in combination with a carrier, a two-component type electrostatic image developer is prepared.

The carrier which can be used in the present invention is not particularly limited, but examples of the carrier usually employed include a magnetic particle such as iron powder, ferrite, iron oxide powder and nickel; a resin-coated carrier obtained by coating the surface of a magnetic particle as a core material with a resin such as styrene-based resin, vinyl-based resin, ethylene-based resin, rosin-based resin, polyester-based resin and melamine-based resin or with a wax such as stearic acid to form a resin coat layer; and a magnetic material dispersion-type carrier obtained by dispersing magnetic particles in a binder resin. Above all, a resin-coated carrier is preferred, because the electrostatic property of the toner or the resistance of the entire carrier can be controlled by the construction of the resin coat layer.

The mixing ratio between the toner of the present invention and the carrier in the two-component type electrostatic image developer is usually from 2 to 10 parts by weight of toner per 100 parts by weight of carrier. The preparation method of the developer is not particularly limited but examples thereof include a method of mixing the toner and the carrier by a V blender.

IV. Image Forming Method and Image Forming Apparatus

The image forming method of the present invention includes: an electrostatic latent image forming step of forming an electrostatic latent image on a surface of a latent image holding member; a developing step of developing the electrostatic latent image formed on the surface of the latent image holding member with a developer to form a toner image; a transfer step of transferring the toner image formed on the surface of the latent image holding member onto a transferee surface; and a pressure-fixing step of pressurizing and fixing but not heating the toner image transferred onto the transferee surface, wherein the developer is the electrostatic image developing toner for pressure fixing of the present invention, an electrostatic image developing toner for pressure fixing obtained by the production method of the present invention, or the electrostatic image developer of the present invention.

The image forming apparatus of the present invention includes: a latent image holding member; a charging unit that electrostatically charges the latent image holding member; an exposure unit that exposes the electrostatically charged latent image holding member to form an electrostatic latent image on the latent image holding member; a developing unit that develops the electrostatic latent image with a developer to form a toner image; a transfer unit that transfers the toner image formed on a surface of the latent image holding member onto a transferee surface; and a pressure-fixing unit that pressurizes and fixes the toner image transferred onto the transferee surface, wherein the electrostatic image developing toner for pressure fixing of the present invention, an electrostatic image developing toner for pressure fixing obtained by the production method of the present invention, or the electrostatic image developer of the present invention is used as the developer.

The image forming method and image forming apparatus of the present invention are described below.

In the image forming method of the present invention, a developer is prepared using the above-described electrostatic image developing toner for pressure fixing, an electrostatic image is formed and developed using the developer in a normal electrophotographic copying machine, and the toner image obtained is electrostatically transferred onto a transfer paper and then pressure-fixed by a pressure roller fixing device set to a given pressure, whereby a copy image is formed.

The image forming method of the present invention is preferably used in particular when performing high-speed fixing where the contact time between the toner on the transfer paper and the pressure roller is within 1 second, particularly within 0.5 seconds.

The electrostatic image developer for pressure fixing (electrostatic image developing toner for pressure fixing) of the present invention may be used in an image forming method employing a normal electrostatic image developing system (electrophotographic system). Specifically, the image forming method of the present invention preferably includes, for example, an electrostatic latent image forming step, a developing step (a toner image forming step), a transfer step, a pressure-fixing step and a cleaning step. Each of these steps itself is a general step and is described, for example, in JP-A-56-40868 (the term "JP-A" as used herein means an "unexamined published Japanese patent application") and JP-A-49-91231. Incidentally, the image forming method of the present invention may be performed using a known image forming apparatus such as copying machine or facsimile machine.

The electrostatic latent image forming step is a step of forming an electrostatic latent image on a surface of a latent image holding member.

The toner image forming step is a step of developing the electrostatic latent image with a developer layer on a developer carrier to form a toner image. The developer layer is not particularly limited as long as it contains the electrostatic image developer of the present invention containing the electrostatic image developing toner for pressure fixing of the present invention.

The transfer step is a step of transferring the toner image onto a transfer material. The cleaning step is a step of removing the electrostatic image developer remaining on the electrostatic latent image holding member.

In a preferred embodiment, the image forming method of the present invention further includes a recycling step. The recycling step is a step of returning the electrostatic image developing toner collected in the cleaning step to the developer layer. The image forming method in this embodiment including a recycling step can be performed using an image forming apparatus such as toner recycling system-type copying machine or facsimile machine. The image forming method of the present invention may also be applied to a recycling system in an embodiment where the cleaning step is omitted and the toner is collected simultaneously with the development.

The maximum pressure at the image fixing in the pressure-fixing step is preferably from 1 to 10 MPa.

The maximum pressure at the pressure-fixing by a fixing machine in the conventional electrophotographic process is usually 1 MPa or less and is practically set to the range from 0.2 to 0.6 MPa in many cases.

The maximum pressure at the fixing in the pressure-fixing step is preferably 1 MPa or more, because good fixability on cardboard can be obtained, and is preferably 10 MPa or less, because the performance in terms of hot offset temperature is good and staining of image, contamination or paper winding of fixing roll, or curling, waving or the like of paper hardly occurs. Incidentally, paper curling indicates the state of paper after fixing being greatly curved.

The pressure distribution, for example, between fixing rolls or pressure rolls can be measured by a commercially available pressure distribution measuring sensor. Specifically, the pressure distribution can be measured, for example, by a roller-roller pressure measuring system manufactured by Kamata Industry Co., Ltd. In the present invention, the maximum pressure at the pressure fixing means the maximum pressure in a pressure change of a fixing nip from the inlet to the outlet along the paper traveling direction.

Suitable examples of the transferee which can be used in the image forming method of the present invention include plain paper, cardboard, OHP sheet, coated paper obtained by coating the plain paper surface with resin or the like, and art paper sheet for printing. As for the transferee, use of cardboard is preferred, because the effects of the present invention can be remarkably exerted.

The cardboard as used herein indicates paper having a basis weight of 90 g/m$^2$ or more.

The image forming method of the present invention is a method excellent particularly for image formation on cardboard, and this image forming method is preferred because in a high-speed fixing using cardboard, the fixing energy can be reduced while satisfying both high image quality and reliability.

The present invention not only realizes excellent image formation on cardboard but also exhibits effective performance without problem for plain paper having a basis weight of 90 g/m$^2$ or less and enables reducing the fixing energy or enhancing the image forming speed per hour with the same energy.

EXAMPLES

The present invention is described in greater detail below by referring to Examples, but the present invention is not limited to the following Examples. In Examples below, unless otherwise indicated, the "parts" means "parts by weight", and "%" means "wt %".

In the measurement of the molecular weight, the weight average molecular weight Mw was measured under the following conditions by gel permeation chromatography (GPC).

The measurement was performed at a temperature of 40° C. by flowing a solvent (tetrahydrofuran) at a flow rate of 1.2 ml/min and injecting 3 mg as the sample weight of a tetrahydrofuran sample solution in a concentration of 0.2 g/20 ml. In the measurement of the molecular weight of the sample, the measurement conditions were selected such that the molecular weight of the sample was included in the range where a straight line was formed by the logarithm of the molecular weight and the count number in a calibration curve produced from several kinds of monodisperse polystyrene standard samples. In this connection, the reliability of the measurement results can be confirmed from the fact that the molecular weight of an NBS706 polystyrene standard sample measured under the above-described conditions becomes:

weight average molecular weight Mw=28.8×10$^4$ number average molecular weight Mn=13.7×10$^4$ As for the column of GPC, a column satisfying the above-described conditions, such as TSK-GEL or GMH (produced by Tosoh Corp.), was used.

The median diameter was measured by a laser diffraction particle size distribution analyzer (LA-920, manufactured by Horiba, Ltd.) or Coulter Multisizer II (manufactured by Beckman Coulter).

The glass transition temperature and melting point of the resin were measured using a differential scanning calorimeter (DSC-50, manufactured by Shimadzu Corp.).

In the fixing and image quality maintenance tests, a modified machine of DocuCentre Color f450 manufactured by Fuji Xerox Co., Ltd. was used.

As for the fixing machine, a two roll-type fixing machine capable of adjusting the maximum fixing pressure was modified and furthermore, the image-side pressure roll was changed to a high-hardness roll prepared by coating Teflon (registered trademark) on a SUS tube of ϕ30 mm.

As for the transfer paper, C2 paper produced by Fuji Xerox Co., Ltd. was used.

Example 1

| (Resin Particle Liquid Dispersion (1): high Tg resin) | |
|---|---|
| Styrene | 450 parts |
| n-Butyl acrylate | 150 parts |
| Acrylic acid | 12 parts |
| Dodecanethiol | 9 parts |

These components were mixed and dissolved to prepare a solution.

Separately, 20 parts of an anionic surfactant (DOWFAX 2A1, produced by Dow Chemical) was dissolved in 250 parts of ion exchanged water. The solution prepared above was added thereto and dispersed/emulsified in a flask (Monomer Emulsion A).

Furthermore, 3 parts of the same anionic surfactant (DOWFAX 2A1, produced by Dow Chemical) was dissolved in 555 parts of ion exchanged water and the resulting solution was charged into a polymerization flask.

The polymerization flask was tightly plugged and after a reflux tube was equipped, the polymerization flask was heated to 75° C. on a water bath while injecting nitrogen and slowly stirring, and kept in this state.

Subsequently, 9 parts of ammonium persulfate was dissolved in 43 parts of ion exchanged water, the resulting solution was added dropwise into the polymerization flask through a metering pump over 20 minutes, and then Monomer Emulsion A was added dropwise through a metering pump over 200 minutes.

Thereafter, the polymerization flask was kept at 75° C. for 3 hours while continuing slowly stirring to complete the polymerization.

In this way, Resin Particle Liquid Dispersion (1) having a central particle diameter of 75 nm, a glass transition temperature of 51° C., a weight average molecular weight of 29,000 and a solid content of 42 wt % was obtained.

| (Resin Particle Liquid Dispersion (2): low Tg resin) | |
|---|---|
| Styrene | 100 parts |
| n-Butyl acrylate | 500 parts |
| Acrylic acid | 12 parts |
| Dodecanethiol | 9 parts |

These components were mixed and dissolved to prepare a solution.

Separately, 20 parts of an anionic surfactant (DOWFAX 2A1, produced by Dow Chemical) was dissolved in 250 parts of ion exchanged water. The solution prepared above was added thereto and dispersed/emulsified in a flask (Monomer Emulsion B).

Furthermore, 3 parts of the same anionic surfactant (DOWFAX 2A1, produced by Dow Chemical) was dissolved in 555 parts of ion exchanged water and the resulting solution was charged into a polymerization flask.

The polymerization flask was tightly plugged and after a reflux tube was equipped, the polymerization flask was heated to 75° C. on a water bath while injecting nitrogen and slowly stirring, and kept in this state.

Subsequently, 9 parts of ammonium persulfate was dissolved in 43 parts of ion exchanged water, the resulting solution was added dropwise into the polymerization flask through a metering pump over 20 minutes, and then Monomer Emulsion B was added dropwise through a metering pump over 200 minutes.

Thereafter, the polymerization flask was kept at 75° C. for 3 hours while continuing slowly stirring to complete the polymerization.

In this way, Resin Particle Liquid Dispersion (2) having a central particle diameter of 50 nm, a glass transition temperature of 10° C., a weight average molecular weight of 26,000 and a solid content of 42 wt % was obtained.

| (Preparation of Colorant Particle Liquid Dispersion (P1)) | |
|---|---|
| Cyan pigment (copper phthalocyanine, C.I. Pigment Blue 15:3, produced by Dainichiseika Colour & Chemicals Mfg. Co., Ltd.) | 50 parts |
| Anionic surfactant (Neogen RK, produced by Dai-ichi Kogyo Seiyaku Co., Ltd.) | 5 parts |
| Ion exchanged water | 200 parts |

These components were mixed and dissolved and the resulting solution was dispersed by a homogenizer (Ultra-turrax, manufactured by IKA Works, Inc.) for 5 minutes and further by an ultrasonic bath for 10 minutes to obtain Cyan Colorant Particle Liquid Dispersion (P1) having a central diameter of nm and a solid content of 21.5 wt %.

Toner Example 1

The Ratio of Low Tg Resin to High Tg Resin is 1.0

| (Preparation of Toner Particle) | |
|---|---|
| Resin Particle Liquid Dispersion (1) | 50 parts (resin: 21 parts) |
| Resin Particle Liquid Dispersion (2) | 100 parts (resin: 42 parts) |
| Colorant Particle Liquid Dispersion (P1) | 40 parts (pigment: 8.6 parts) |
| Polyaluminum chloride | 0.15 parts |
| Ion exchanged water | 300 parts |

In accordance with the formulation above, the components were thoroughly mixed/dispersed in a stainless steel-made round flask by using a homogenizer (Ultra-turrax T50, manufactured by IKA Works, Inc.), then heated to 42° C. while stirring the flask on a heating oil bath and kept at 42° C. for 60 minutes and after adding 50 parts (resin: 21 parts) of Resin Particle Liquid Dispersion (1), the system was gently stirred.

Thereafter, the system was adjusted to a pH of 6.0 with 0.5 mol/liter of an aqueous sodium hydroxide solution and then heated to 95° C. while continuing stirring. In the course of temperature rise to 95° C., the pH in the system usually decreases to 5.0 or less, but here, an aqueous sodium hydroxide solution was additionally added dropwise to keep the pH from lowering to 5.5 or less.

After the completion of reaction, the reaction solution was cooled, filtered, thoroughly washed with ion exchanged water and then subjected to solid-liquid separation by Nutche-type suction filtration. The solid portion was again dispersed in 3 liter of ion exchanged water at 40° C., and the system was stirred at 100 rpm for 15 minutes by using a stainless steel impeller and washed. After repeating the washing operation 3 times, solid-liquid separation was performed by Nutche-type suction filtration, and the solid portion was dried under vacuum for 12 hours to obtain toner particles.

The particle diameter of the toner particles was measured by a Coulter counter, as a result, the accumulated volume average particle diameter $D_{50}$ was 4.8 μm and the volume average particle size distribution index GSDv was 1.22. Also, the shape factor SF1 of the toner particles as determined by shape observation using a Luzex image analyzer was 130.

The cross-sectional observation by a transmission electron microscope revealed that low Tg resin portions were distributed like islands, and the average major axis as calculated using a Luzex image analyzer was 110 nm.

1.5 Parts of hydrophobic silica (TS720, produced by Cabot Corp.) was added to 50 parts of the toner particles obtained above and mixed in a sample mill to obtain an external addition toner.

Subsequently, a ferrite carrier having an average particle diameter of 50 μm, which is coated with polymethyl methacrylate (produced by Soken Chemical & Engineering Co., Ltd.) to a coverage of 1 wt %, and the external addition toner after weighing it to give a toner concentration of 5 wt %, were stirred and mixed in a ball mill for 5 minutes to prepare a developer.

(Evaluation of Toner)

The evaluation was performed using the developer prepared above in a modified machine of DocuCenter Color f450 manufactured by Fuji Xerox Co., Ltd. At this time, the two roll-type fixing machine was modified to give a maximum fixing pressure of 5 MPa (50 kgf/cm$^2$), heating was not applied, A4 size C2 paper of Fuji Xerox Co., Ltd. was used as the transfer paper, the toner weight per unit area at the formation of a solid image was adjusted to 4 g/m$^2$, the coverage of the toner solid image in the A4 paper was set to 60%, and the paper was passed lengthwise.

The fixability of the toner was examined by rubbing with cloth, as a result, cloth contamination or image missing was not observed and the fixability was good. The paper after fixing was examined for curling and waving by a method of fixing the paper short side with a ruler on a board having a smooth and horizontal surface, and the maximum value out of the lifting value at the end on the opposite side and the waving height was measured by a gauge and found to be 3.5 mm which was much below the allowable range (10 mm or less). Thus, the performance in terms of curling or waving was good.

Also, when a continuous printing test of 50,000 sheets was performed using the modified machine above in a laboratory environment, good image quality at the initial stage was maintained to the end (continuous image quality maintenance: A).

Example 2

| (Resin Particle Liquid Dispersion (3): high Tg resin) | |
|---|---|
| 1,4-Cyclohexanedicarboxylic acid | 175 parts |
| Bisphenol A ethylene oxide 2-mol adduct | 320 parts |
| Dodecylbenzenesulfonic acid | 0.5 parts |

These materials were charged into a reactor equipped with a stirrer, and polycondensation was performed at 120° C. for 10 hours in a nitrogen atmosphere to obtain a uniform and transparent polyester resin. The weight average molecular weight by GPC was 11,000 and the glass transition temperature was 50° C.

The materials above were charged into a reactor equipped with a stirrer and dissolved/mixed at 120° C. for 30 minutes, and a neutralizing aqueous solution obtained by dissolving 3 parts of sodium dodecylbenzenesulfonate and 1.0 parts of an aqueous 1N NaOH solution in 800 parts of ion exchanged water heated at 95° C. was charged into the flask. After emulsification by a homogenizer (Ultra-turrax, manufactured by IKA Works, Inc.) for 5 minutes, the flask was further shaken for 10 minutes in an ultrasonic bath and then cooled with water at room temperature. In this way, Resin Particle Liquid Dispersion (3) having a median particle diameter of 70 nm and a solid content of 20 wt % was obtained.

| (Resin Particle Liquid Dispersion (4): low Tg resin) | |
|---|---|
| 1,4-Cyclohexanedicarboxylic acid | 87.5 parts |
| Bisphenol A ethylene oxide 6-mol adduct | 200 parts |
| Bisphenol S ethylene oxide 2-mol adduct | 31 parts |
| Trimellitic anhydride | 0.5 parts |
| p-Toluenesulfonic acid | 0.5 parts |

These materials were mixed and charged into a reactor equipped with a stirrer, and polycondensation was performed at 120° C. for 6 hours in a nitrogen atmosphere to obtain a uniform and white polyester resin. The weight average molecular weight by GPC was 9,000 and the glass transition temperature was 15° C.

The materials above were charged into a reactor equipped with a stirrer and dissolved/mixed at 120° C. for 30 minutes, and a neutralizing aqueous solution obtained by dissolving 3 parts of sodium dodecylbenzenesulfonate and 1.0 parts of an aqueous 1N NaOH solution in 800 parts of ion exchanged water heated at 95° C. was charged into the flask. After emulsification by a homogenizer (Ultra-turrax, manufactured by IKA Works, Inc.) for 5 minutes, the flask was further shaken for 10 minutes in an ultrasonic bath and then cooled with water at room temperature. In this way, Resin Particle Liquid Dispersion (4) having a median particle diameter of 55 nm and a solid content of 20 wt % was obtained.

Toner Example 2

The Ratio of Low Tg Resin to High Tg Resin is 0.33

| (Preparation of Toner Particle) | |
|---|---|
| Resin Particle Liquid Dispersion (3) | 200 parts (resin: 40 parts) |
| Resin Particle Liquid Dispersion (4) | 100 parts (resin: 20 parts) |
| Colorant Particle Liquid Dispersion (P1) | 40 parts (pigment: 8.6 parts) |
| Polyaluminum chloride | 0.15 parts |
| Ion exchanged water | 300 parts |

In accordance with the formulation above, the components were thoroughly mixed/dispersed in a stainless steel-made round flask by using a homogenizer (Ultra-turrax T50, manufactured by IKA Works, Inc.), then heated to 42° C. while stirring the flask on a heating oil bath and kept at 40° C. for 60 minutes and after adding 100 parts (resin: 20 parts) of Resin Particle Liquid Dispersion (3), the system was gently stirred.

Thereafter, the system was adjusted to a pH of 6.5 with 0.5 mol/liter of an aqueous sodium hydroxide solution and then heated to 95° C. while continuing stirring. In the course of temperature rise to 95° C., the pH in the system usually decreases to 5.5 or less, but here, an aqueous sodium hydroxide solution was additionally added dropwise to keep the pH from lowering to 5.5 or less.

After the completion of reaction, the reaction solution was cooled, filtered, thoroughly washed with ion exchanged water and then subjected to solid-liquid separation by Nutche-type suction filtration. The solid portion was again dispersed in 3 liter of ion exchanged water at 40° C., and the system was stirred at 100 rpm for 15 minutes by using a stainless steel impeller and washed. After repeating the washing operation 3 times, solid-liquid separation was performed by Nutche-type suction filtration, and the solid portion was dried under vacuum for 12 hours to obtain toner particles.

The particle diameter of the toner particles was measured by a Coulter counter, as a result, the accumulated volume average particle diameter $D_{50}$ was 4.6 μm and the volume average particle size distribution index GSDv was 1.24. Also, the shape factor SF1 of the toner particles as determined by shape observation using a Luzex image analyzer was 133.

The cross-sectional observation by a transmission electron microscope revealed that low Tg resin portions as the resin component in a smaller ratio were distributed like islands, and the average major axis as calculated using a Luzex image analyzer was 130 nm.

1.5 Parts of hydrophobic silica (TS720, produced by Cabot Corp.) was added to 50 parts of the toner particles obtained above and mixed in a sample mill to obtain an external addition toner.

Subsequently, a ferrite carrier having an average particle diameter of 50 μm, which is coated with polymethyl methacrylate (produced by Soken Chemical & Engineering Co., Ltd.) to a coverage of 1 wt %, and the external addition toner after weighing it to give a toner concentration of 5 wt %, were stirred and mixed in a ball mill for 5 minutes to prepare a developer.

(Evaluation of Toner)

The evaluation was performed using the developer prepared above in a modified machine of DocuCenter Color f450 manufactured by Fuji Xerox Co., Ltd. At this time, the two roll-type fixing machine was modified to give a maximum fixing pressure of 5 MPa (50 kgf/cm$^2$), heating was not applied, A4 size C2 paper of Fuji Xerox Co., Ltd. was used as the transfer paper, the toner weight per unit area at the formation of a solid image was adjusted to 4 g/m$^2$, the coverage of the toner solid image in the A4 paper was set to 60%, and the paper was passed lengthwise.

The fixability of the toner was examined by rubbing with cloth, as a result, the fixability was good. The paper after fixing was examined for curling and waving by a method of fixing the paper short side with a ruler on a board having a smooth and horizontal surface, and the maximum value out of the lifting value at the end on the opposite side and the waving height was measured by a gauge and found to be 6.5 mm which was much below the allowable range (10 mm or less). Thus, the performance in terms of curling or waving was good.

Also, when a continuous printing test of 50,000 sheets was performed using the modified machine above in a laboratory environment, good image quality at the initial stage was maintained to the end (continuous image quality maintenance: A).

Comparative Example 1

The Median Diameter of Resin Particle is 100 nm or More and the Major Axis of Island is 150 nm or More Comparative Toner 1 was produced in the same manner as in Example 1 by using Resin Particle Liquid Dispersion (5) below in place of Resin Particle Liquid Dispersion (2) in Example 1.

| (Resin Particle Liquid Dispersion (5): low Tg resin) | |
|---|---|
| Styrene | 100 parts |
| n-Butyl acrylate | 500 parts |
| Acrylic acid | 12 parts |
| Dodecanethiol | 9 parts |

These components were mixed and dissolved to prepare a solution.

Separately, 5 parts of an anionic surfactant (DOWFAX 2A1, produced by Dow Chemical) was dissolved in 250 parts of ion exchanged water. The solution prepared above was added thereto and dispersed/emulsified in a flask (Monomer Emulsion C).

Furthermore, 3 parts of the same anionic surfactant (DOWFAX 2A1, produced by Dow Chemical) was dissolved in 555 parts of ion exchanged water and the resulting solution was charged into a polymerization flask.

The polymerization flask was tightly plugged and after a reflux tube was equipped, the polymerization flask was heated to 75° C. on a water bath while injecting nitrogen and slowly stirring, and kept in this state.

Subsequently, 9 parts of ammonium persulfate was dissolved in 43 parts of ion exchanged water, the resulting solution was added dropwise into the polymerization flask through a metering pump over 20 minutes, and then Monomer Emulsion C was added dropwise through a metering pump over 200 minutes.

Thereafter, the polymerization flask was kept at 75° C. for 3 hours while continuing slowly stirring to complete the polymerization. In this way, Resin Particle Liquid Dispersion (5) having a central particle diameter of 120 nm, a glass transition temperature of 10° C., a weight average molecular weight of 26,000 and a solid content of 42 wt % was obtained.

Toner Comparative Example 1

The particle diameter of toner particles of Comparative Toner 1 was measured by a Coulter counter, as a result, the accumulated volume average particle diameter $D_{50}$ was 5.3 μm and the volume average particle size distribution index GSDv was 1.23. Also, the shape factor SF1 of the toner particles as determined by shape observation using a Luzex image analyzer was 127, and the toner particles were slightly spherical.

The cross-sectional observation by a transmission electron microscope revealed that low Tg resin portions were distributed like islands, and the average major axis as calculated using a Luzex image analyzer was 160 nm.

A developer was produced in the same manner as in Example 1 by using the toner of Comparative Example 1.

(Evaluation of Toner)

The evaluation was performed using the developer prepared above in a modified machine of DocuCenter Color f450 manufactured by Fuji Xerox Co., Ltd. At this time, the two roll-type fixing machine was modified to give a maximum fixing pressure of 5 MPa (50 kgf/cm$^2$), heating was not applied, A4 size C2 paper of Fuji Xerox Co., Ltd. was used as the transfer paper, the toner weight per unit area at the formation of a solid image was adjusted to 4 g/m$^2$, the coverage of the toner solid image in the A4 paper was set to 60%, and the paper was passed lengthwise.

The fixability of the toner was examined by rubbing with cloth, as a result, cloth contamination was generated despite no image missing and the fixability was slightly poor. Then, fixing was performed by raising the fixing pressure to 8 MPa, but at this time, when the paper after fixing was examined for curling and waving by a method of fixing the paper short side with a ruler on a board having a smooth and horizontal surface, the maximum value out of the lifting value at the end on the opposite side and the waving height measured by a gauge was 11 mm and exceeded the allowable range (10 mm or less). Also, a continuous printing test of 50,000 sheets by using the modified machine above in a laboratory environment could not be performed.

Comparative Example 2

Tg Difference is Less than 30° C.

| (Resin Particle Liquid Dispersion (6): low Tg resin) | |
|---|---|
| 1,4-Cyclohexanedicarboxylic acid | 87.5 parts |
| Bisphenol A ethylene oxide 6-mol adduct | 197 parts |
| Bisphenol S ethylene oxide 2-mol adduct | 34 parts |
| Trimellitic anhydride | 0.5 parts |
| p-Toluenesulfonic acid | 0.5 parts |

These materials were mixed and charged into a reactor equipped with a stirrer, and polycondensation was performed at 120° C. for 8 hours in a nitrogen atmosphere to obtain a uniform and white polyester resin. The weight average molecular weight by GPC was 15,000 and the glass transition temperature was 25° C.

The materials above were charged into a reactor equipped with a stirrer and dissolved/mixed at 120° C. for 30 minutes, and a neutralizing aqueous solution obtained by dissolving 3 parts of sodium dodecylbenzenesulfonate and 1.0 parts of an aqueous 1N NaOH solution in 800 parts of ion exchanged water heated at 95° C. was charged into the flask. After emulsification by a homogenizer (Ultra-turrax, manufactured by IKA Works, Inc.) for 5 minutes, the flask was further shaken for 10 minutes in an ultrasonic bath and then cooled with water at room temperature. In this way, Resin Particle Liquid Dispersion (6) having a median particle diameter of 55 nm and a solid content of 20 wt % was obtained.

Toner Comparative Example 2

A toner was produced in the same manner except for changing Resin Particle Liquid Dispersion (4) to Resin Particle Liquid Dispersion (6) in Toner Example 2.

The particle diameter of toner particles of Comparative Example 2 was measured by a Coulter counter, as a result, the accumulated volume average particle diameter $D_{50}$ was 4.8 μm and the volume average particle size distribution index GSDv was 1.25. Also, the shape factor SF1 of the toner particles as determined by shape observation using a Luzex image analyzer was 130, and the toner particle was potato-shaped.

The cross-sectional observation by a transmission electron microscope revealed that low Tg resin portions as the resin component in a smaller ratio were distributed like islands, and the average major axis as calculated using a Luzex image analyzer was 150 nm.

A developer was produced in the same manner as in Example 2 by using the toner of Comparative Example 2.

(Evaluation of Toner)

The evaluation was performed using the developer prepared above in a modified machine of DocuCenter Color f450 manufactured by Fuji Xerox Co., Ltd. At this time, the two roll-type fixing machine was modified to give a maximum fixing pressure of 5 MPa (50 kgf/cm$^2$), heating was not applied, A4 size C2 paper of Fuji Xerox Co., Ltd. was used as the transfer paper, the toner weight per unit area at the formation of a solid image was adjusted to 4 g/m$^2$, the coverage of the toner solid image in the A4 paper was set to 60%, and the paper was passed lengthwise.

The fixability of the toner was examined by rubbing with cloth, as a result, cloth contamination and image missing were observed and the fixability was poor. Even when the fixing pressure was raised to 10 MPa, the fixability was still insufficient.

Incidentally, since a fixed image was not obtained, the evaluation of paper curling was not performed.

Also, a continuous printing test of 50,000 sheets by using the modified machine above in a laboratory environment could not be performed.

Comparative Example 3

The Ratio of Low Tg Resin to High Tg Resin is Less than 0.25 (0.235)

A toner was produced in the same manner except for changing the toner composition to the following in Toner Example 1.

| | |
|---|---|
| Resin Particle Liquid Dispersion (1) | 120 parts (resin: 50.4 parts) |
| Resin Particle Liquid Dispersion (2) | 40 parts (resin: 16.8 parts) |
| Colorant Particle Liquid Dispersion (P1) | 40 parts (pigment: 8.6 parts) |
| Polyaluminum chloride | 0.15 parts |
| Ion exchanged water | 300 parts |

Toner Comparative Example 3

The particle diameter of toner particles of Comparative Example 3 was measured by a Coulter counter, as a result, the accumulated volume average particle diameter $D_{50}$ was 5.5 μm and the volume average particle size distribution index GSDv was 1.23. Also, the shape factor SF1 of the toner particles as determined by shape observation using a Luzex image analyzer was 131, and the toner particle was potato-shaped.

The cross-sectional observation by a transmission electron microscope revealed that low Tg resin portions as the resin component in a smaller ratio were distributed like islands, though the number of islands was small, and the average major axis as calculated using a Luzex image analyzer was 90 nm.

A developer was produced in the same manner as in Example 1 by using the toner of Toner Comparative Example 3.

(Evaluation of Toner)

The evaluation was performed using the developer prepared above in a modified machine of DocuCenter Color f450 manufactured by Fuji Xerox Co., Ltd. At this time, the two roll-type fixing machine was modified to give a maximum fixing pressure of 5 MPa (50 kgf/cm$^2$), heating was not applied, A4 size C2 paper of Fuji Xerox Co., Ltd. was used as the transfer paper, the toner weight per unit area at the formation of a solid image was adjusted to 4 g/m$^2$, the coverage of the toner solid image in the A4 paper was set to 60%, and the paper was passed lengthwise.

The fixability of the toner was examined by rubbing with cloth, as a result, cloth contamination was generated despite no image missing and the fixability was slightly poor. Then, evaluation was performed by raising the fixing pressure to 10 MPa and improvement tendency was exhibited, but when the paper after fixing was examined for curling and waving by a method of fixing the paper short side with a ruler on a board having a smooth and horizontal surface, the maximum value out of the lifting value at the end on the opposite side and the waving height measured by a gauge was 13 mm and exceeded the allowable range (10 mm or less).

Also, a continuous printing test of 50,000 sheets by using the modified machine above in a laboratory environment could not be performed.

What is claimed is:

1. An electrostatic image developing toner for pressure fixing, comprising:

a binder resin comprising two kinds of resin particles fused together to form a sea-island structure, wherein an island phase contained in the sea-island structure consists of a plurality of island phases, a difference between a glass transition temperature of the resin particles forming a sea phase contained in the sea-island structure and a glass transition temperature of the resin particles forming the island phase is about 30° C. or more, both of the glass transition temperatures of the resin particles forming the sea phase and the resin particles forming the island phase are less than about 55° C., and the island phase has a major axis of about 150 nm or less, the major axis of the island phase being determined by observing an arbitrary section of the electrostatic image developing toner and calculating an average major axis of a plurality of island phases observed in the arbitrary section.

2. The electrostatic image developing toner for pressure fixing as claimed in claim 1, wherein a ratio of a weight of the resin particles forming the island phase to a weight of the resin particles forming the sea phase is about 0.25 or more.

3. The electrostatic image developing toner for pressure fixing as claimed in claim 1, wherein the glass transition temperature of the resin particles forming the sea phase is higher than the glass transition temperature of the resin particles forming the island phase.

4. The electrostatic image developing toner for pressure fixing as claimed in claim 1, wherein at least one of the two kinds of resin particles forming the sea-island structure are crystalline resin particles.

5. An electrostatic image developer comprising:

the electrostatic image developing toner for pressure fixing claimed in claim 1; and a carrier.

6. A production method of an electrostatic image developing toner for pressure fixing, comprising:

dispersing two kinds of resin particles in an aqueous medium, wherein both of the two kinds of resin particles have a glass transition temperature of less than about 55° C. and a difference between the glass transition temperatures of the two kinds of resin particles is about 30° C. or more;

aggregating the two kinds of dispersed resin particles to obtain aggregated particles; and heating and fusing the aggregated particles to form a sea-island structure, wherein both of the two kinds of resin particles have a median diameter of about 100 nm or less, an island phase contained in the sea-island structure consists of a plurality of island phases, and the island phase contained in the sea-island structure has a major axis of about 150 nm or less, the major axis of the island phase being determined by observing an arbitrary section of the electrostatic image developing toner and calculating an average major axis of a plurality of island phases observed in the arbitrary section.

7. An image forming method comprising:

forming an electrostatic latent image on a surface of a latent image holding member;

developing the electrostatic latent image formed on the surface of the latent image holding member with a developer to form a toner image;

transferring the toner image formed on the surface of the latent image holding member onto a transferee surface; and pressurizing and fixing the toner image transferred onto the transferee surface, wherein the developer comprises the electrostatic image developing toner for pressure fixing claimed in claim 1.

* * * * *